US005608955A

United States Patent [19]

Bozzo

[11] Patent Number: 5,608,955

[45] Date of Patent: Mar. 11, 1997

[54] FABRIC FINISHING MACHINE WITH AIR-JET FABRIC TO DRUM ENTRAINER

[75] Inventor: Lino Bozzo, Quaregna, Italy

[73] Assignee: Flainox S.R.L., Quaregna, Italy

[21] Appl. No.: 578,065

[22] Filed: Dec. 20, 1995

[30] Foreign Application Priority Data

Dec. 23, 1994 [IT] Italy ..... TO94A1069

[51] Int. Cl.[6] ..... D06B 15/09; B65H 23/24

[52] U.S. Cl. ..... 28/167; 34/637; 226/95; 68/177

[58] Field of Search ..... 28/167; 34/637, 34/650; 226/95, 97; 68/177

[56] References Cited

U.S. PATENT DOCUMENTS 3,503,134 3/1970 Fleissner ..... 28/167

FOREIGN PATENT DOCUMENTS

| | | | |
|---|---|---|---|
| 246100 | 11/1987 | European Pat. Off. . | |
| 1034054 | 7/1953 | France . | |
| 2312589 | 12/1976 | France . | |
| 1710479 | 9/1971 | Germany . | |
| 652644 | 4/1951 | United Kingdom | 34/155 |

*Primary Examiner*—Andy Falik
*Attorney, Agent, or Firm*—Banner & Witcoff, Ltd.

[57] ABSTRACT

A fabric-finishing machine comprises a tank in which there is a series of drums driven in the same direction and forming an entrainment path extending from the front portion of the tank to the rear portion in a rectilinear direction. The drums entrain a single piece of fabric spread out or a plurality of pieces gathered into ropes. At least one nozzle is associated with each drum, for supplying an air-jet which presses the fabric, spread out or in ropes, onto the respective cylinder so as to achieve conditions of adhesion such that dry, moist or wet fabrics can be entrained.

12 Claims, 7 Drawing Sheets

FABRIC FINISHING MACHINE WITH AIR-JET FABRIC TO DRUM ENTRAINER

BACKGROUND OF THE INVENTION

Figure 1:
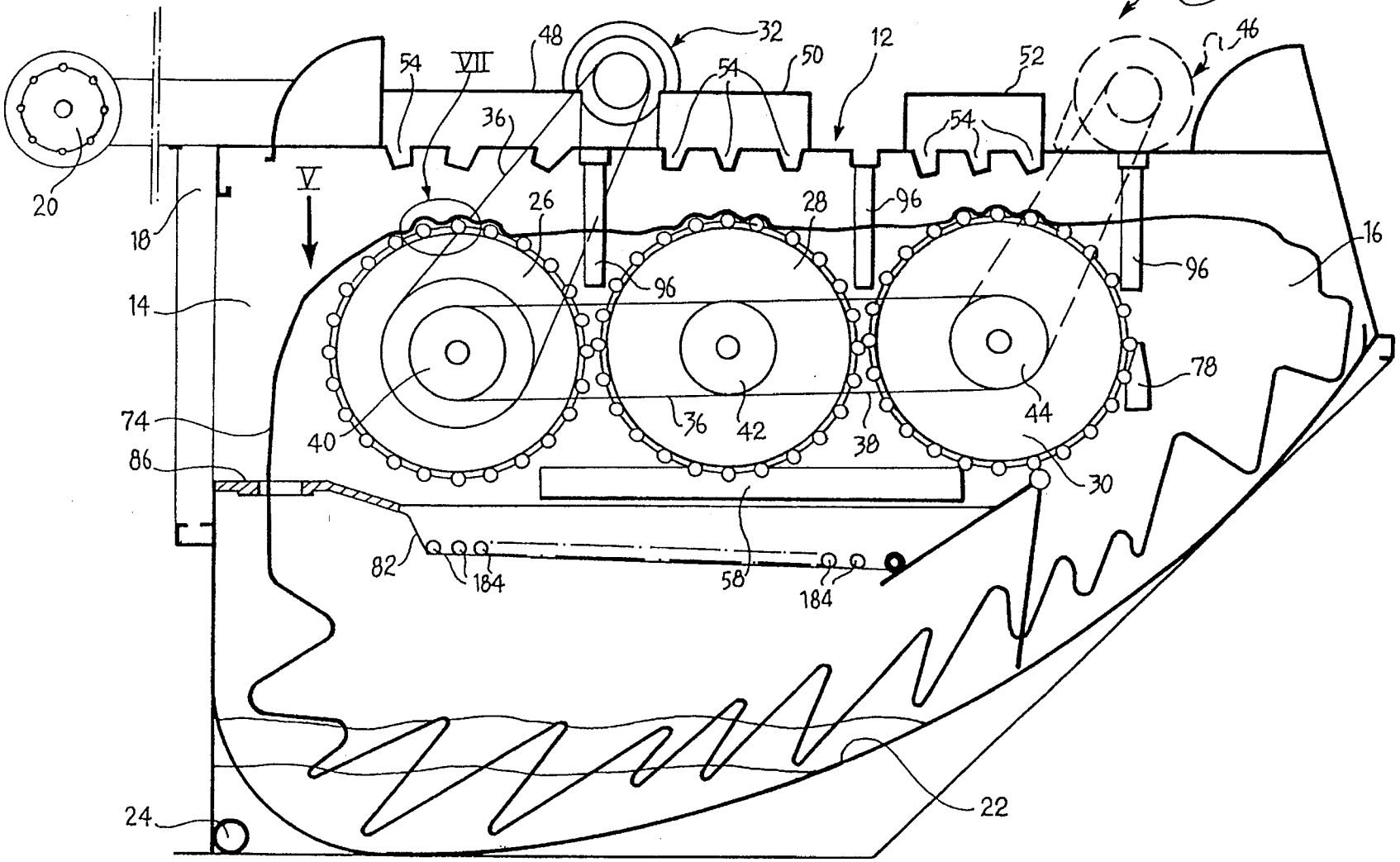

The present invention relates to fabric-finishing operations.

Finishing means the set of operations which are carried out on fabrics to confer on them certain characteristics which improve their appearance, presentation, and drape and render them more suitable for the purposes for which they are intended.

Finishing or dressing techniques involve problems of a mechanical, physical and chemical nature. In general, during finishing, account must be taken of the possible reactions of the fabric to the mechanical operations, to humidity, to heat, to steam and to the various chemical reagents. The methods of carrying out the finishing therefore depend on many factors such as, for example, the type and quality of the raw material, the physical properties of the fibres, the susceptibility of the fabric to absorb auxiliary finishing products, the susceptibility of the material to chemical change, etc.

All this involves the need to modify the operative parameters of the finishing step according to the type of fabric (woollen fabrics, cotton fabrics, mixed fabrics with chemical fibres, combed fabrics, carded fabrics, etc.) and according to the type of treatment to be achieved. There are many finishing steps to which a fabric may be subjected and amongst these may be mentioned wet treatment with enzymes or complementary finishing products, raising of fabrics, washing, bleaching, etc. Some fabrics, owing to their nature, require the finishing treatment to be carried out whilst they are spread out whereas others can be washed in ropes. Moreover, according to the type of treatment, steps may be carried out wet, that is, in the presence of a bath, with moist fabric (which has previously been subjected to wringing or spinning), or with dry fabric.

SUMMARY OF THE INVENTION

The object of the present invention is to provide a versatile finishing machine which can operate in the presence of a bath, with moist or with dry fabrics, cold or with hot air circulating, and which can equally well treat fabrics spread out or in ropes.

According to the present invention, this object is achieved by a fabric-finishing machine comprising a tank and entrainment means for moving the fabric continuously from a front portion of the tank to a rear portion, characterized in that the entrainment means comprise a set of drums which form an entrainment path extending from the front portion of the tank to the rear portion, the widths of the drums being such as to permit the entrainment of a single piece of fabric spread out or of a plurality of pieces gathered into ropes, and in that at least one nozzle is associated with each drum, for supplying an air-jet to press the fabric spread out or in ropes onto the respective drum so as to achieve conditions of adhesion between the fabric and the drums such that dry, moist or wet fabrics can be entrained.

The machine according to the invention can carry out wet finishing treatments with enzymes or complementary finishing products, treatments for raising fabric in ropes and spread out, moist and dry, and washing in ropes and spread out. All of the treatments listed above can be done cold or with hot air circulating. Treatment with hot air enables the fabrics to be dried upon completion of the wet or moist treatment, completing any process already in progress in the machine and dimensionally stabilizing (shrinking) the fabric. Treatments on dry fabric can change the feel or handle of the fabric. The air jets which press the fabric onto the drums enable the fabric to be entrained even in conditions of poor adhesion (typical with dry fabric) without the need to compress the fabric between two contra-rotating rollers which would cause the formation of creases, particularly in delicate fabrics.

Further characteristics and advantages of the present invention will become clear in the course of the detailed description which follows given purely by way of nonlimiting example, with reference to the appended drawings, in which:

BRIEF DESCRIPTION OF THE PREFERRED EMBODIMENT

Figure 2:
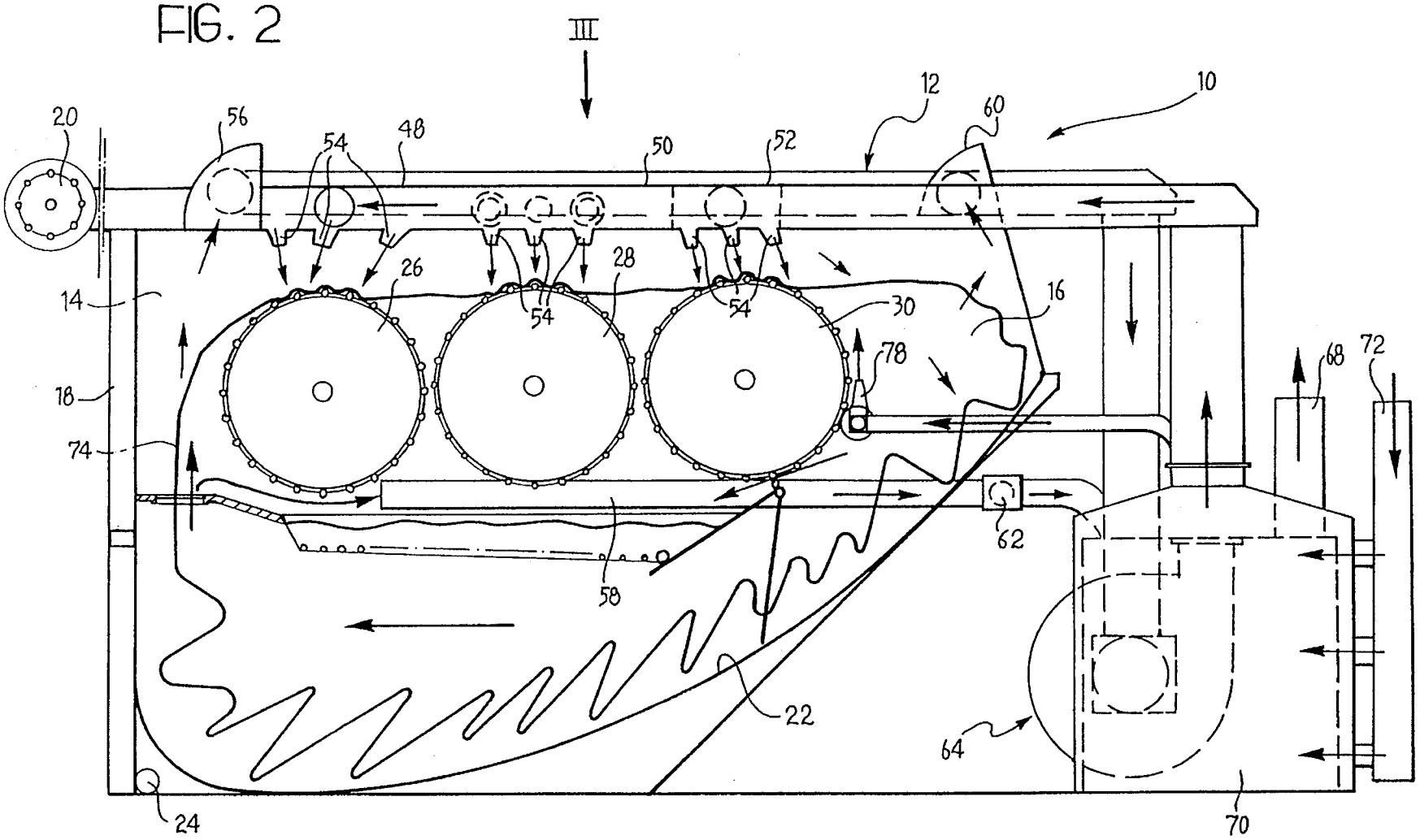
Figure 3:
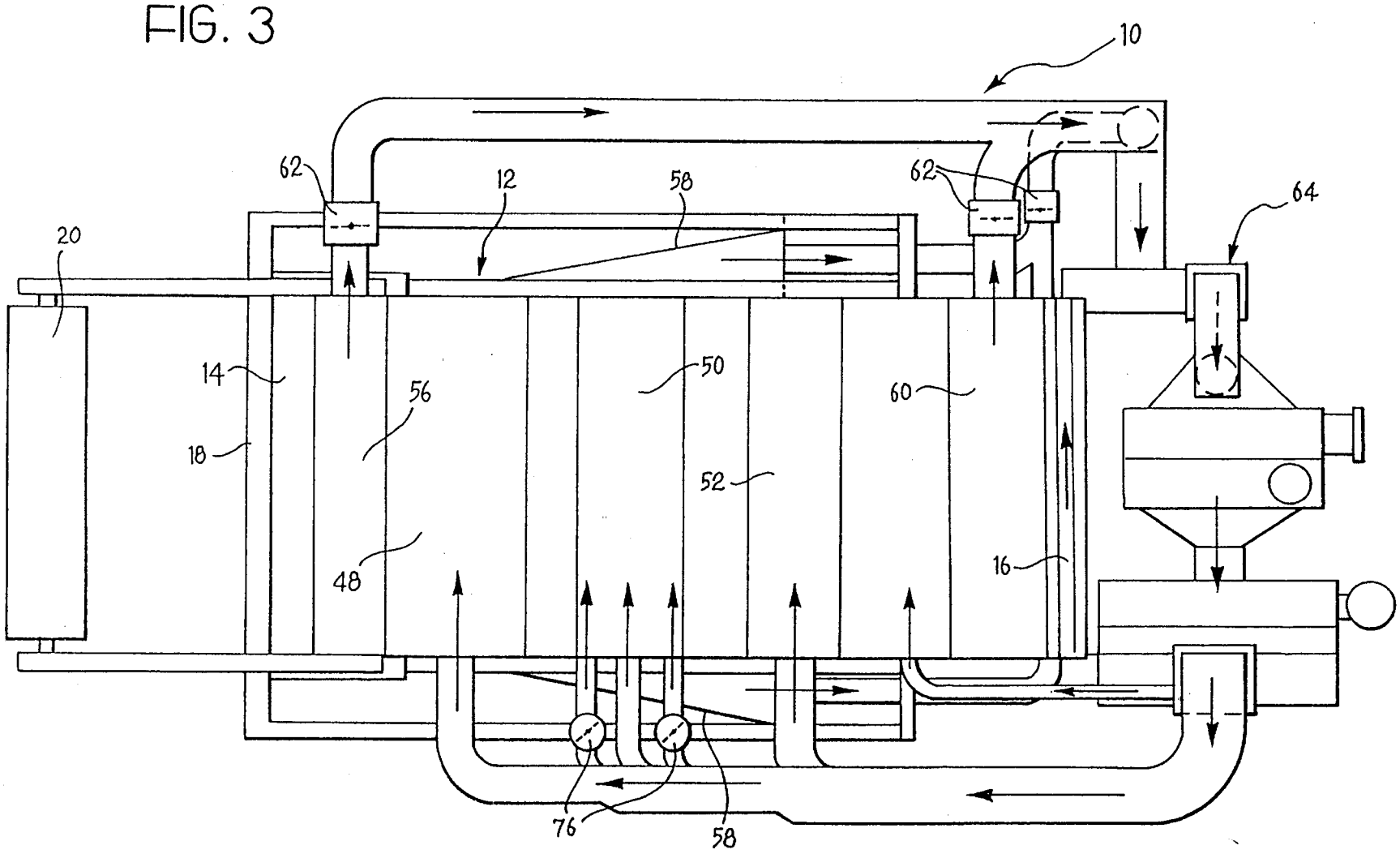
Figure 4:
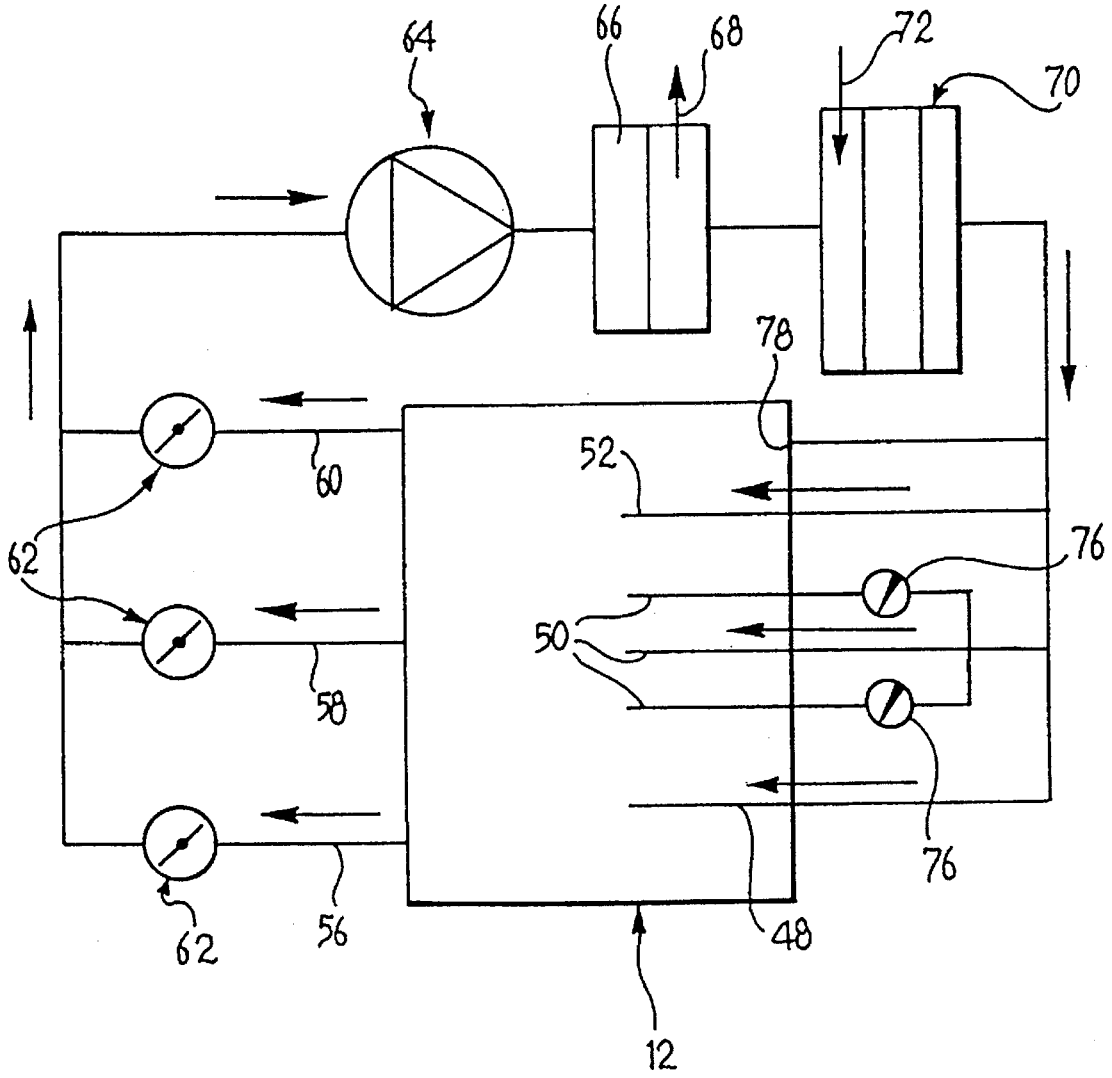
Figure 5:
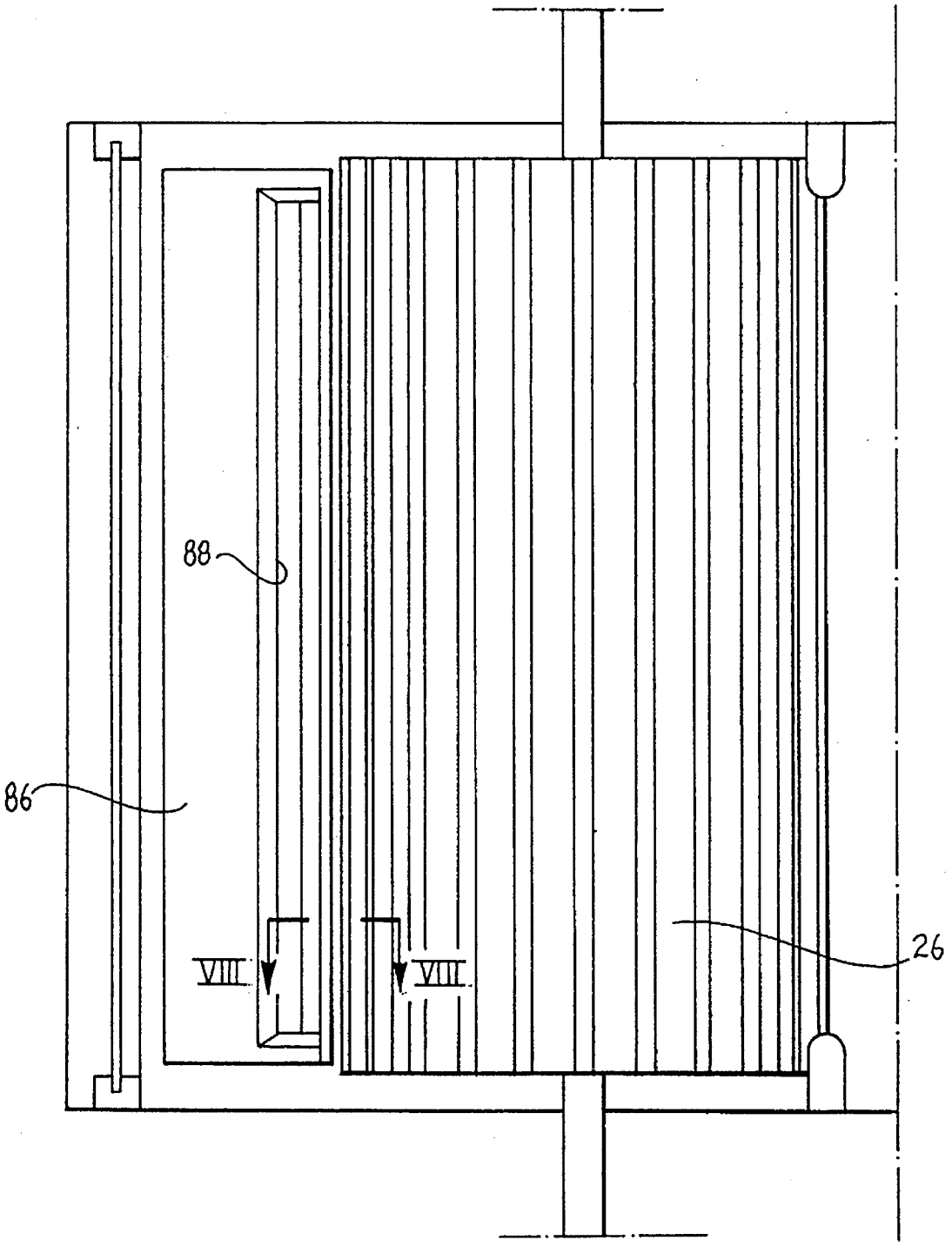
Figure 6:
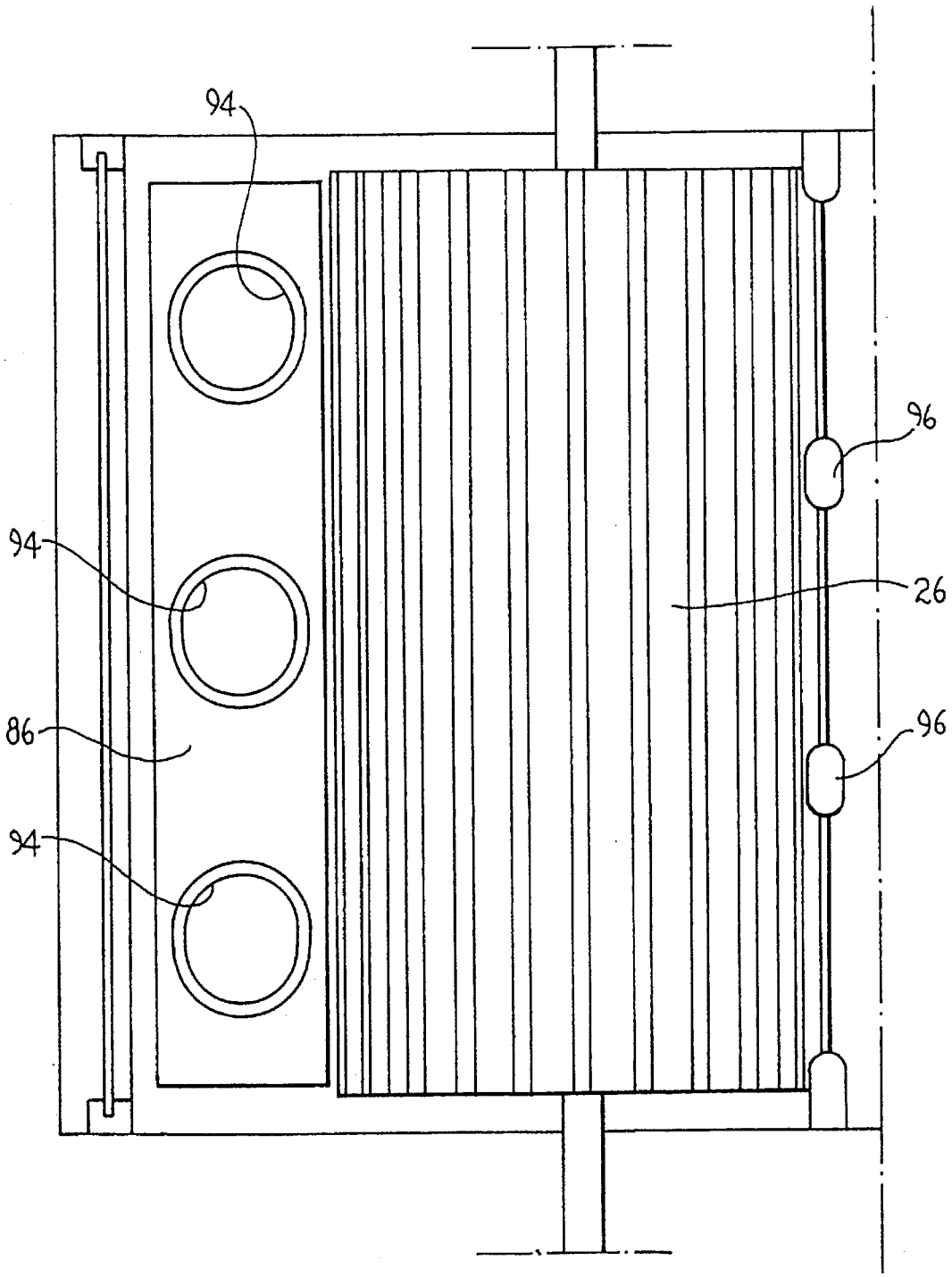
Figure 7:
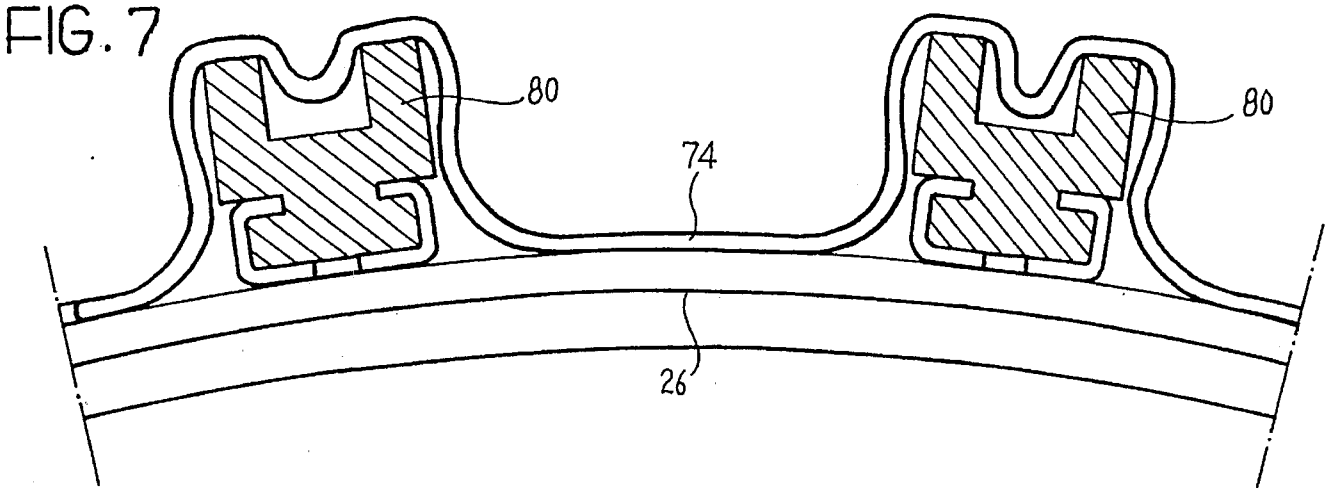
Figure 9:
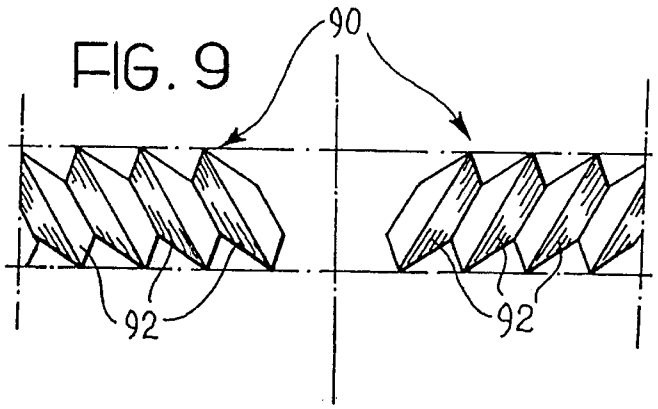
Figure 8:
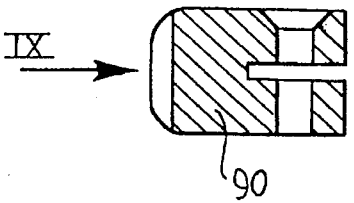

FIG. 1 is a schematic side view of a machine according to the present invention, FIG. 2 is a side view similar to that of FIG. 1 with the addition of the circuit for supplying the air jets, FIG. 3 is a plan view taken on the arrow III of FIG. 2, FIG. 4 is a diagram showing the distribution of the air-flows in the machine according to the invention, FIG. 5 is a plan view taken on the arrow V of FIG. 1 of the machine arranged for working with spread-out fabrics, FIG. 6 is a view similar to that of FIG. 5, showing the machine arranged for working with fabrics in ropes, FIG. 7 is a detail of the part indicated by the arrow VII in FIG. 1, on an enlarged scale, FIG. 8 is a section taken on the arrow VIII—VIII of FIG. 5, on an enlarged scale, and FIG. 9 is a partial view taken on the arrow IX of FIG. 8.

With reference to FIGS. 1 to 3, the finishing machine according to the present invention is generally indicated at 10 and comprises a closed tank 12 having a front portion 14 and a rear portion 16. In the front portion 14 of the tank 12 there is an openable door 18 for the insertion and removal of the fabric to be treated.

A reel 20 is disposed outside the tank 12 for facilitating the discharge of the fabric. The tank 12 has an arcuate base wall 22 coated internally with self-lubricating plastics material (for example, TEFLON®) to facilitate the sliding of the fabric. In the vicinity of the base wall 22 of the tank 12 there is a pipe 24 (FIGS. 1 and 2) connected to a pump (not shown) for the admission and discharge of a treatment bath.

Inside the tank 12 there is a system for entraining the fabric, composed of a series of drums 26, 28 and 30 side by side defining an entrainment path in the upper portion of the tank 12, extending from the front portion 14 of the tank 12 to the rear portion 16. In the embodiment shown in the drawings, there are three entrainment drums but there could be a smaller or larger number according to the length of the tank and according to the diameters selected for the drums.

The drums 26, 28, 30 extend throughout the width of the tank 12 and can equally well entrain a single piece of fabric spread out or a plurality of pieces (for example, three) gathered into ropes.

The entrainment drums 26, 28 and 30 are preferably rotated at different speeds, increasing in the direction of advance of the fabric (from the front portion to the rear portion of the tank 12). Different speeds of rotation of the drums enable the fabric to be kept taut in the space between the drums, preventing jamming. Moreover, different speeds of rotation of the drums cause slight slippage of the fabric relative to the drums 26 and 28 and this helps to give a feel to the fabric, changing its surface appearance. Friction due to the sliding of the fabric on the drums 26 and 28 also causes a beneficial increase in temperature inside the tank 12 reducing the amount of heat which has to be supplied from outside to maintain a certain working temperature inside the tank 12.

Although the different speeds of rotation of the entrainment drums have the advantages explained above, this characteristic is not essential for the purposes of the present invention and the various entrainment drums may also be driven at the same speed of rotation.

As can be seen in FIG. 1, the various entrainment drums may be driven by a single variable-speed electric motor 32 by means of a transmission with toothed belts 34, 36 and 38. Different speeds of rotation of the drums 26, 28 and 30 are achieved by the provision of drive pulleys with drums 40, 42 and 44 having different numbers of teeth. The last drum 30 may have a pulley 44 with a variable diameter in order to vary its speed of rotation in comparison with the other drums 26 and 28 to change the conditions of sliding of the fabric. Alternatively, the last drum 30 could have an independent drive achieved by means of its own variable-speed motor 46 indicated in chain line in FIG. 1.

Still with reference to FIGS. 1–3, the machine according to the invention has a series of compressed-air supply ducts 48, 50 and 52, the number of ducts being equal to the number of entrainment drums and the ducts being disposed above the respective drums. A series of supply nozzles 54 extending from each of the air-supply ducts 48, 50, 52 sends jets of air onto the drums 26, 28 and 30.

With reference to the diagram of FIG. 4, the temperature and humidity of the air jets is controlled by the circuit supplying the air-flow to the ducts 48, 50 and 52 which comprises three intake ducts 56, 58 and 60 which draw the air inside the tank 12. The intake ducts 56, 58 and 60 have respective shutter valves 62 and are connected to the suction side of a fan 64. Downstream of the fan 64 there is a self-cleaning filter 66 of known type having an adjustable opening (indicated by the arrow 68) for discharging some of the moist air drawn from inside the tank 12 to the atmosphere. Downstream of the self-cleaning filter 66 there is a heating battery 70 which is supplied with steam and in which there is also an adjustable opening 72 through which a quantity of ambient air is re-admitted to the air-flow. At the outlet of the heating battery 70, the air-flow is sent to the supply nozzles situated inside the tank 12.

As can be seen in FIGS. 1 and 2, the air-jets coming out of the supply nozzles 54 urge the fabric 74 (spread out or in ropes) onto the entrainment drums 26, 28 and 30, bringing about conditions of adhesion between the fabric 74 and the entrainment drums such that fabrics of any weight and with any liquid content (dry, damp or wet) can be lifted and entrained. In effect, the air jets are useful particularly when the machine is operating without a bath, with fabrics which have been spun or dried. In fact, in these conditions, the fabric is lighter and, in the absence of the air-jets, there would not be sufficient adhesion between the drums and the fabric to achieve effective entrainment of the fabric.

It should be noted that the entrainment system according to the invention avoids compressing the fabric between two rigid surfaces as occurs, for example, with the contra-rotating rollers which are used in previously-known entrainment systems, and this prevents the formation of creases which is of fundamental importance for delicate fabrics.

The air-jet coming out of one or more of the nozzles 54 may be pulsed to increase the napping effect on the fabric. This can be achieved by providing shutter valves 76 in the supply ducts of the nozzles (FIG. 4), the valves being opened and closed successively so as to produce a pulsed air-jet with a percussion effect on the fabric.

The ducts for the taking in the air-flow inside the tank 12 are preferably arranged so as to facilitate the circulation of the fabric 74. With reference to FIGS. 2 and 3, a first intake opening 56 is disposed in the front portion 14 of the tank 12 above the entrainment path of the fabric. The intake opening 56 thus facilitates the lifting of the fabric from the base of the tank, particularly in conditions in which the fabric is dry. A second intake opening 60 is disposed in the rear portion 16 of the tank 12 in a raised position relative to the fabric, where it generates an upward air movement which keeps the fabric ejected from the last drum 30 raised, preventing the fabric from jamming on the last drum 30.

There are also two lateral intake openings 58 on the sides of the tank 12 below the entrainment drums 26, 28 and 30. The lateral intake openings 58, in combination with the air-jets coming out of the nozzles 54, create a downward air-flow in the central portion of the machine, improving the adhesion of the fabric to the entrainment drums.

The air-supply circuit comprises a further supply nozzle 78 (FIG. 2) situated immediately downstream of the last entrainment drum 30. The nozzle 78 sends an upward air-jet onto the fabric 74 to facilitate the detachment of the fabric from the drum 30 and prevent jamming of the fabric on the drum.

With reference now to FIG. 7, a plurality of strips 80 is disposed on the outer surface of each entrainment drum 26, 28, 30, the strips projecting from the outer surface of the drum and extending parallel to the axis of rotation thereof. The strips are made of soft material such as, for example, silicone rubber and have a generally U-shaped configuration so that, under the action of the air-jets coming out of the openings 54, the fabric 74 is arranged as shown in FIG. 7, increasing the area of the fabric wound on the drum and increasing the force which can be transmitted to the fabric by the drum.

With reference again to FIGS. 1 and 2, beneath the entrainment drums 26, 28, 30, there is a basin 82 in which some of the treatment liquid which is lifted above the normal level of the bath by the circulating fabric collects. In the bottom of the basin 82 there is a heat-exchanger 184 with a coil supplied with hot water or steam which heats the treatment bath in the basin 82. As the work proceeds, the heated treatment liquid flows over the upper edge of the basin 82 and falls to the bottom of the tank 12 from where it is picked up again and lifted by the circulating fabric, so as to fall back into the basin 82. For finishing treatments carried out in the presence of a bath, it is thus possible to control the temperature of the treatment liquid.

In the front portion 14 of the tank 12 there is a fabric-guide element, indicated 86 in FIGS. 1 and 2. If the machine is arranged for working with spread-out fabric, the guide element 86 has the shape shown in FIG. 5. In this case, the guide element is constituted by a rectangular plate in which there is an elongate slot 88 of a width equal to or greater than that of the piece of fabric. As can be seen in FIGS. 8 and 9, an edge of the slot 88 carries a rubber element 90 having teeth 92 in a herring-bone arrangement diverging from the centerline, with reference to the direction of advance of the fabric. As it circulates, the fabric tends to slide against the element 90 and the diverging teeth 92 tend to keep the fabric in its spread-out position.

For working with fabric in ropes, it is sufficient to remove the guide element 86 and replace it with a guide element of a different shape, such as that shown in FIG. 6. In this case, the guide element has a series of substantially circular spaced-apart holes 94 (three in the embodiment shown) through which the various ropes of fabric pass.

When the machine is working with fabric in ropes and hence with the guide element 86 of the type shown in FIG. 6, spacer pins 96 are interposed (FIGS. 1 and 6) between two adjacent ropes along the path of entrainment of the fabric. The pins 96 are retractible and are raised when the machine is working with spread-out fabric.

In order to change the arrangement of the machine from working with spread-out fabric to working with fabric in ropes or vice versa, it therefore suffices to remove the guide element 86 and replace it with a guide element of a different type and to raise or lower the spacer pins 96. The guide element 86 is replaced manually, operating through the openable door 18.

The machine according to the invention operates as follows.

A piece of fabric with a length of the order of 300 m or more is inserted in the machine through the openable door 18 and is arranged spread out or in a rope according to the type of fabric and the type of treatment to be carried out. For treatment in ropes, the machine can hold several pieces of fabric (for example, three). The piece (or pieces) of fabric are sewn end-to-end, the door 18 is closed and the fabric is entrained at high speed by means of the drums 26, 28 and 30. In order to carry out treatments in the presence of a bath, the required quantity of bath is admitted to the tank through the pipe 24.

The speeds of the entrainment drums are adjustable and speeds of entrainment of the fabric of up to 800 to 1000 m per minute can be achieved. During the treatment, air is supplied to the supply nozzles 54. Upon completion of the moist treatment, the machine can dry the fabric by discharging the bath, continuing to entrain the fabric and subjecting it to the air-jets. In order to dry the fabric, it is necessary to heat and dehumidify the air-flow circulating through the tank 12.

It is also possible to carry out finishing treatments without a bath, by introducing previously wrung or spun fabric into the machine. In this case, the high-speed circulation of the fabric with consequent friction and incidental impacts against the walls of the machine as well as friction against the drums and any percussion of the air-jet change the surface appearance of the fabric and achieve a characteristic feel of the fabric.

What is claimed is:

1. A fabric-finishing machine, comprising:

a tank having a front portion and rear portion, a set of drums which form a substantially rectilinear entrainment path extending above the drums from the front portion of the tank to the rear portion, the widths of the drums being such as to permit the entrainment thereon of a single piece of fabric spread out or of a plurality of pieces gathered in ropes, drive means for rotating the drums in the same direction, and at least one nozzle associated with each drum for supplying an air-jet to press the fabric spread out or in ropes onto the respective drum so as to achieve conditions of adhesion between the fabric and the drums such that dry, moist or wet fabrics can be entrained.

2. A machine according to claim 1, wherein the air-jet supply nozzles are supplied by a blowing circuit which takes in the air-flow at one at least selected point inside the machine so as to facilitate the circulation of the fabric.

3. A machine according to claim 2, wherein the blowing circuit comprises an intake opening situated in the front portion of the tank above the base of the tank.

4. A machine according to claim 2, wherein the blowing circuit comprises an intake opening situated in the rear portion of the tank, above the path of the fabric.

5. A machine according to claim 2, further comprising a pair of lateral intake openings situated on the sides of the tank below the entrainment path of the fabric.

6. A machine according to claim 1, further comprising at least one supply nozzle situated downstream of the last drum with reference to the direction of advance of the fabric and arranged in a manner such as to send onto the fabric an air-jet which tends to detach the fabric from the last drum.

7. A machine according to claim 1, wherein the drums have means providing different speeds of rotation, increasing in the direction of advance of the fabric.

8. A machine according to claim 1, including means for controlling the temperature and humidity conditions of the air-jets by exchanging the air in the tank with the outside atmosphere and by heating the air flow in order to dry the fabric.

9. A machine according to claim 1, further comprising a guide element for the fabric situated in the front portion of the tank, the guide element having an elongate slot for guiding a spread-out piece of fabric and being replaceable with a guide element having two or more substantially circular and spaced-apart holes for guiding two or more pieces gathered into ropes.

10. A machine according to claim 1, wherein a plurality of strips of soft material is disposed on the outer surface of each drum, the strips extending parallel to the axis of rotation of the drum and projecting from the outer surface of the drum.

11. A machine according to claim 10, wherein the strips have substantially U-shaped cross sections.

12. A fabric-finishing machine, comprising:

a closed tank having a front portion and a rear portion, a set of drums which form an entrainment path extending from the front portion of the tank to the rear portion, the width of the drums being such as to permit the entrainment of a single piece of fabric spread out or of a plurality of pieces gathered in ropes, and a blowing circuit including at least one intake opening located inside the tank, fan means for drawing air from said at least one intake opening and for supplying at least one nozzle associated with each drum with an air-jet to press the fabric spread out or in ropes onto the respective drum, so as to achieve conditions of adhesion between the fabric and the drums such that dry, moist or wet fabrics can be entrained.

* * * * *